United States Patent [19]

Kurokawa

[11] Patent Number: 4,840,505

[45] Date of Patent: Jun. 20, 1989

[54] ELECTRONIC TYPEWRITER RIBBON LIFT-UP APPARATUS

[75] Inventor: Yasuyoshi Kurokawa, Nara, Japan

[73] Assignee: Sharp Kabushiki Kaisha, Osaka, Japan

[21] Appl. No.: 875,532

[22] Filed: Jun. 18, 1986

[30] Foreign Application Priority Data

Jun. 21, 1985 [JP] Japan ..... 60-136339

[51] Int. Cl.[4] ..... B41J 29/36

[52] U.S. Cl. ..... 400/697.1; 400/214; 400/208

[58] Field of Search ..... 400/194, 195, 196, 196.1, 400/206, 207, 208, 208.1, 214, 216.1, 240, 240.4, 695, 696, 697, 697.1

[56] References Cited

U.S. PATENT DOCUMENTS

| | | | |
|---|---|---|---|
| 4,472,073 | 9/1984 | Valle et al. | 400/697.1 X |
| 4,573,813 | 3/1986 | Aoki et al. | 400/697.1 X |
| 4,589,788 | 5/1986 | Lendl | 400/697.1 X |
| 4,601,596 | 7/1986 | Musso | 400/697.1 |
| 4,605,324 | 8/1986 | Musso | 400/697 X |

FOREIGN PATENT DOCUMENTS

| | | | |
|---|---|---|---|
| 0038215 | 10/1981 | European Pat. Off. . | |
| 0150100 | 7/1985 | European Pat. Off. . | |
| 0186892 | 7/1986 | European Pat. Off. . | |
| 0202039 | 11/1986 | European Pat. Off. . | |
| 59-12891 | 1/1984 | Japan . | |
| 2176747 | 1/1987 | United Kingdom | 400/697 |

*Primary Examiner*—Ernest T. Wright, Jr.

*Attorney, Agent, or Firm*—Birch, Stewart, Kolasch & Birch

[57] ABSTRACT

A ribbon lift-up apparatus for selectively rotating a ribbon cartridge holder to the printing position or the correcting position uses a disc cam provided with various cam grooves for the printing operation and correcting operation, respectively. The disc cam includes a circular first cam groove for continuous printing operation. The first cam groove has a specified radius with the rotation axis of the disc cam as a center thereof. A second cam groove for single type printing operation is provided and a cam follower pin is positioned initially at a home position in this second cam groove. The second cam groove is in communication with the first cam groove. A third cam groove for a correcting operation is also provided. The follower pin will initially be at the home position of the second cam groove and will cross the first cam groove during the correcting operation. The third cam groove has a smaller radius than the specified radius of the first cam groove. A cam auxiliary plate is rotatably and coaxially provided on the disc cam and comprises a guide portion for the intersection between the first and the third cam grooves and a projection extending at least to the home position to ensure the return of the disc cam to the original position.

4 Claims, 4 Drawing Sheets

FIG. 1
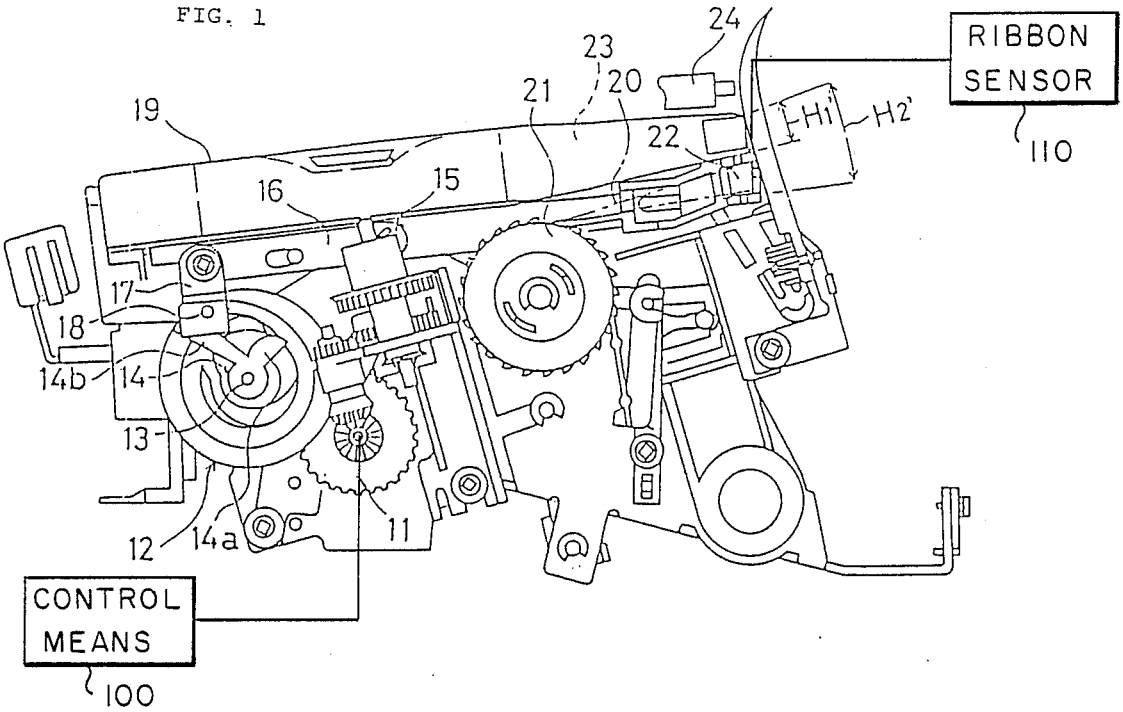
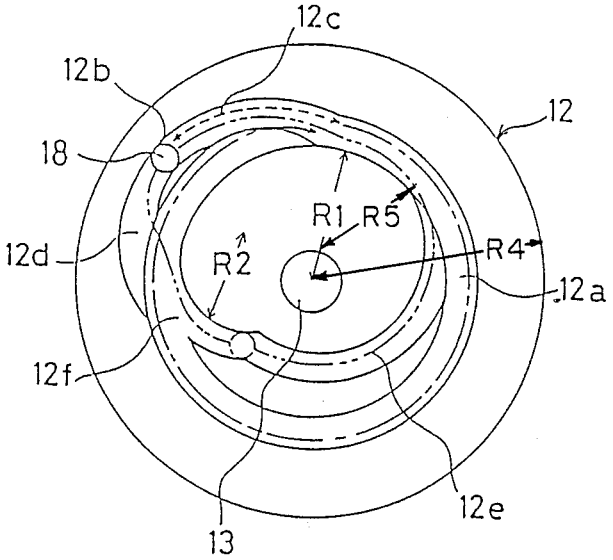
FIG. 2

ELECTRONIC TYPEWRITER RIBBON LIFT-UP APPARATUS

BACKGROUND OF THE INVENTION

The present invention relates to a ribbon lift-up apparatus of an electronic typewriter having printing and correction ribbons.

The conventional ribbon lift-up apparatus employed in the electronic typewriter having printing and correction ribbons is shown in FIG. 7. With key operation for printing, a printing ribbon lift-up signal actuates a ribbon motor 1 to rotate 90 degrees in the forward direction A, rotating a disc cam 2 by 90 degrees in the direction A'. The ribbon motor 1 has a pinion gear 1' which intermeshes with the edge 2' of the disc cam 2 whereby the disc cam 2 may be rotated by rotation of the ribbon motor 1. The pin 4 of a cam follower 3 is thus guided into a printing cam groove 5 having a smaller radius. Then, a ribbon cartridge holder 6 linked with the cam follower 3 rotates around the axis 7, whereby a printing ribbon cartridge 8 loaded on the cartridge holder 6 is lifted up to the hammer (not shown) position for printing. In the intermittent printing operation, the ribbon motor 1 that has rotated 90 degrees in the forward direction A rotates 90 degrees in the direction B, lowering the printing ribbon cartridge 8 before the next lift-up operation for printing. In the continuous printing operation, the ribbon motor 1 that has rotated 90 degrees in the direction A further rotates 90 degrees in the forward direction A for the second type printing. Namely, the second type is printed when the disc cam 2 rotates 180 degrees in the forward direction A from the home position. The disc cam 2 rotates alternately in the forward and reverse directions A', B' between the rotation angles of 90 and 180 degrees from the home position, in continuous printing.

With key operation for correction, on the other hand, a correction ribbon lift-up signal actuates the ribbon motor 1 to rotate 180 degrees in the reverse direction B, thus rotating the disc cam 2 150 degrees in the reverse direction B'. Accordingly, the cam follower pin 4 is guided into a correction cam groove 9 having a larger radius. Then, the ribbon cartridge holder 6 rotates around the axis 7 by a larger degree so that the correction ribbon 10 mounted on the cartridge holder 6 is lifted up to the specified position for correction. The correction ribbon 10 is lowered as the ribbon motor 1 rotates in the direction A, rotating the disc cam 2 in the direction A'.

A specified length (not shown) of the printing or correction ribbon is wound every time before the above-mentioned ribbon lift-up operation. In the conventional ribbon lift-up apparatus in which the disc cam 2 rotates in the forward and reverse directions alternately for each type printing, the printing ribbon needs to be wound for both forward and reverse rotation of the disc cam 2. Consequently, the printing ribbon is wound in the correction operation when the disc cam 2 rotates reversely, which is quite inconvenient from an economical standpoint. In addition, the alternate forward and reverse rotations of the disc cam 2 hampers fast continuous printing operation.

SUMMARY OF THE INVENTION

In view of the foregoing, an object of the present invention is to provide an electronic typewriter ribbon lift-up apparatus capable of faster continuous printing operation and smooth shifting of the printing and correction ribbons to the predetermined position.

Another object of the present invention is to provide an electronic typewriter ribbon lift-up apparatus which allows only the printing ribbon to be wound in the printing operation and only the correction ribbon to be wound in the correction operation.

Other objects and further scope of applicability of the present invention will become apparent from the detailed description given hereinafter. It should be understood, however, that the detailed description and specific examples, while indicating preferred embodiments of the invention, are given by way of illustration only; various changes and modifications within the spirit and scope of the invention will become apparent to those skilled in the art from this detailed description.

To achieve the above objects, according to an embodiment of the present invention, a ribbon lift-up apparatus, which rotates the ribbon cartridge holder selectively to the printing or correcting position by means of a disc cam having two different cam grooves for printing and correcting operations respectively, comprises the disc cam and a cam auxiliary plate rotatably provided on the disc cam, the disc cam being provided with a circular first cam groove of a specified radius for continuous printing operation formed coaxially with the cam, a second cam groove for single type printing operation leading from the home position to the first cam groove, and a third arc cam groove for correction operation of a smaller radius than the specified radius, starting from the home position and crossing the first cam groove, the cam auxiliary plate comprising a guide portion for the intersection between the first and the third cam grooves and a projection extending at least to the home position to return the cam to the original position.

Accordingly, in the continuous print mode, the disc cam always rotates in one direction or forwardly due to the circular first cam groove. When the cam follower pin is located in the intersection between the first and the third cam grooves, the guide portion of the cam auxiliary plate protects the cam follower pin from slipping off the first cam groove into the third cam groove. Moreover, since the disc cam rotates solely in the forward direction in the printing operation and in the reverse direction in the correction operation, it is possible to allow the printing ribbon alone to be wound in the forward rotation of the disc cam and the correction ribbon alone to be wound in the reverse rotation of the cam. Thus, the present invention eliminates the conventional inconvenience that the printing ribbon is wastefully wound in the correction operation.

BRIEF DESCRIPTION OF THE DRAWINGS

The present invention will become more fully understood from the detailed description given hereinbelow and the accompanying drawings which are given by way of illustration only, and thus are not limitative of the present invention and wherein:

FIG. 1 is a right side view of an embodiment of an electronic typewriter ribbon lift-up apparatus of the present invention;

FIG. 2 is an enlarged view of the disc cam of the present invention;

DETAILED DESCRIPTION OF THE INVENTION

Embodiments of the present invention are described below in detail with reference to the drawings.

Figure 7:
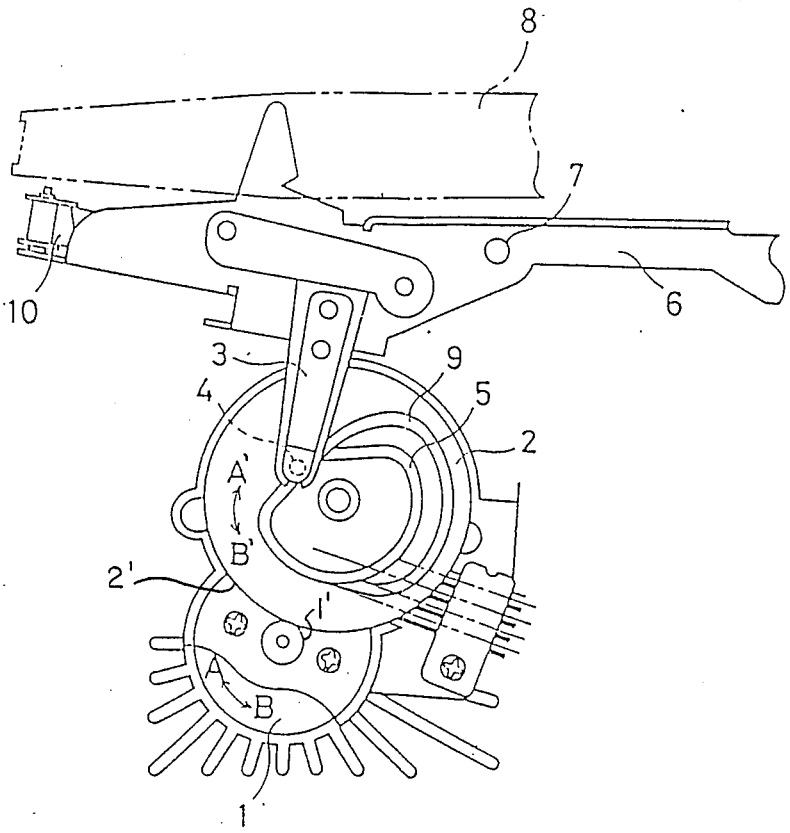
FIG. 7 PRIOR ART
FIG. 7 is a left side view showing the conventional ribbon lift-up apparatus of the electronic typewriter.

Referring to FIG. 1, a disc cam 12 which is operatively connected to a gear 11 is rotated by a stepping motor (not shown) through this gear 11. An interconnection arrangement similar to that shown in FIG. 7 can be used to operatively connect the disc cam 12 to the gear 11. As shown in an enlarged view in FIG. 2, the disc cam 12 is provided with a first circular cam groove 12*a* for continuous printing operation, a second cam groove 12*c* for single type printing operation, a third cam groove 12*d* for correction operation and a fourth cam groove 12*e* for returning operation. The first cam groove 12*a* has a specified radius (inside radius) R1 with the center at the rotation axis 13 of the disc cam 12. The second cam groove 12*c* communicates the home position 12*b* with the first cam groove 12*a* with a specified curvature. The third cam groove 12*d* is of approximate semicircular shape with a radius R2 smaller than the radius R1 and starts from the home position 12*b*, crossing the first cam groove 12*a*. The fourth cam groove 12*e* with a specified curvature R5 connects the third cam groove 12*d* with the first cam groove 12*a*.

A cam auxiliary plate 14 as seen in FIG. 1 is mounted coaxially with the rotation axis 13 of the disc cam 12 and comprises a guide portion 14*a* projecting a bit longer than the radius R1 of the first cam groove 12*a* and a returning projection 14*b* of approximately the same length as the radius R4 of the disc cam 12. The guide portion 14*a* and the projection 14*b* are integrally formed with each other. The cam auxiliary plate 14 is rotatable around the rotation axis 13 but pressed against the disc cam 12 by a compression spring 13' so that it rotates together with the disc cam 12 unless an external force is applied. For clarity, the compression spring 13' is only indicated in FIG. 3(*a*).

The cam follower (or lever mechanism) 17 of the disc cam 12 is engaged with an end of a ribbon cartridge holder 16 which is rotatable around the support axis 15. When the typewriter is not operated, the cam follower pin 18 rests at the home position 12*b* as shown in FIG. 2. A printing ribbon cassette 19 is mounted on the ribbon cartridge holder 16. A correction ribbon (generally called correction tape) 20, which is led from the correction ribbon reel 21 and around the guide roller 22, is positioned under the printing ribbon 23. A printing hammer 24 is provided at the printing position.

The operation of the above embodiment of the present invention is described below with reference to FIGS. 3 through 5.

When a signal from the control means 100 actuates the stepping motor (not shown) to rotate, this rotation is transmitted through the gear 11 to the disc cam 12. The disc cam 12 will then rotate forwardly in the direction C and the cam follower pin 18 will move from the position shown in FIG. 3(*a*) and the dotted line position indicated by 18' in FIG. 3(*b*) to the solid line position shown in FIG. 3(*b*). With this rotation, the cam follower pin 18 lowers by a distance H1, sliding along the second cam groove 12*c* as shown in FIGS. 3(*a*) and 3(*b*), so that the ribbon cartridge holder 16 linked with the cam follower 17 rotates around the support axis 15, lifting up the printing ribbon 23 by a distance H1' as shown in FIG. 1. When only one type is printed, the disc cam 12 rotates in the direction D of FIG. 3(*b*) and returns to the original position shown in FIG. 3(*a*) when a signal is received from the ribbon sensor 110. Accordingly, in an intermittent print mode in which type is printed one by one, the pin 18 reciprocates in the second cam groove 12*c* as shown by a dashed line in FIG. 2.

Figure 3:
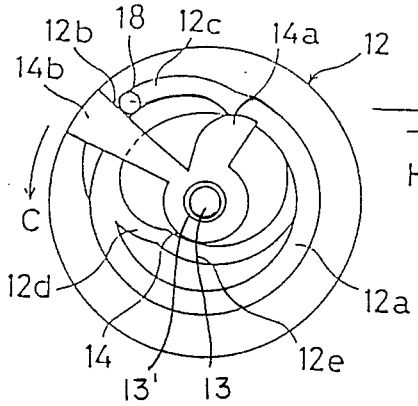
FIGS. 3(*a*) and 3(*b*) are right side views of the essential part of the present invention in the printing mode.
Figure 3:
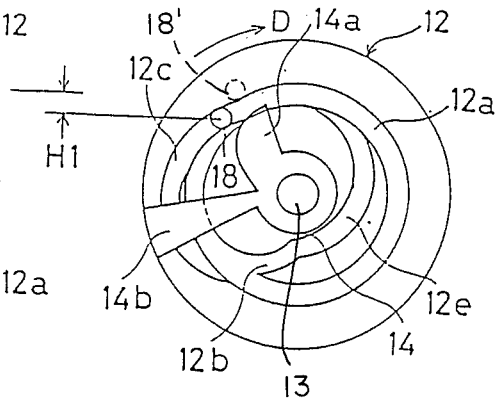
Figure 4:
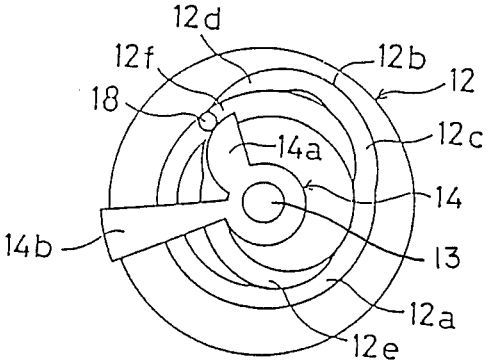
FIG. 4 is a right side view of the essential part of the present invention in the continuous printing mode.

In the continuous print mode, the disc cam 12 rotates continually by a predetermined angle in the direction C of FIG. 3(*a*), so that the pin 18 moves along the circular first cam groove 12*a* as shown by a chain line in FIG. 2. Since the pin 18 is retained at a constant level during this continual rotation as shown in FIG. 3(*b*), the printing ribbon 23 is held at the printing position. Meanwhile, since the guide portion 14*a* of the cam auxiliary plate 14 protrudes slightly into the first cam groove 12*a*, it is kept in contact with the pin 18 and stops rotation while the disc cam 12 is rotating. When the pin 18 comes to the intersection 12*f* between the first cam groove 12*a* and the third cam groove 12*d*, the pin 18 which rides on the guide portion 14*a* continues moving along the first cam groove 12*a* without entering the third cam groove 12*d*, thus ensuring that the printing ribbon 23 is held at the required level.

Figure 5:
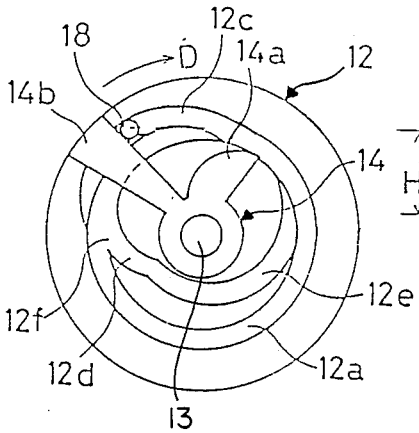
FIGS. 5(*a*) and 5(*b*) are right side views of the essential part of the present invention in the correction mode.
Figure 5:
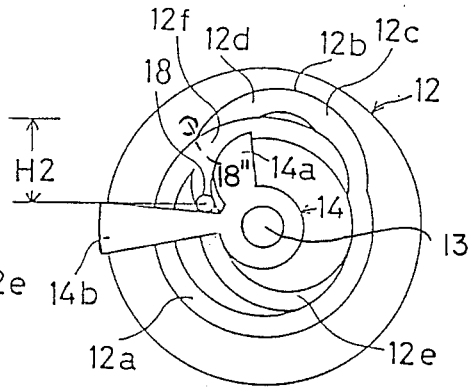

When the control means 100 is actuated for a correction operation, the disc cam 12 rotates 120 degrees in the direction D from the position shown in FIG. 5(*a*) to the position shown in FIG. 5(*b*). With this rotation, the cam follower pin 18 is moved from the dotted line position 18'' in FIG. 5(*b*) to the solid line position 18, thus being lowered by a distance H2. The cam follower pin 18 then moves along the third cam groove 12*d*, lifting up the correction ribbon 20 by a distance H2' as shown in FIG. 1 to the position corresponding to the hammer 24. A printed character is erased by hitting the correction ribbon 20 with the hammer 24. The disc cam 12 further rotates in the direction D until a signal is received from the ribbon sensor 110. Accordingly, the pin 18 travels through the third cam groove 12*d*, the fourth cam groove 12*e*, the first cam groove 12*a* and the second cam groove 12*c* to the home position 12*b*, as shown by a chain double-dashed line in FIG. 2. The cam auxiliary plate 14 whose projection 14*b* is constantly pressed against the pin 18 returns to the original position when the disc cam 12 has made one full turn.

Figure 6:
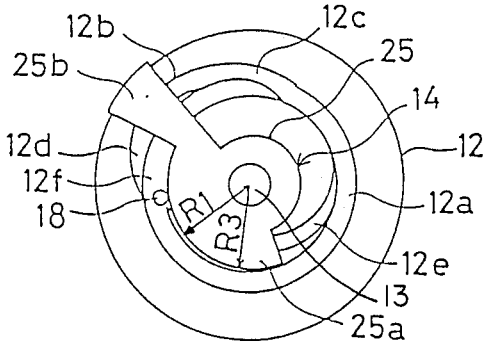
FIG. 6 is a right side view of the essential part of another embodiment of the present invention.

FIG. 6 shows another embodiment of the present invention. In this Figure, the parts which are the same as or equivalent to those of the above embodiment are indicated by the same reference numbers. This second embodiment is different from the first embodiment in that the guide portion 25*a* of the cam auxiliary plate 25 is a sector with a radius R3 a bit smaller than the radius R1 of the first cam groove 12*a* and that the cam auxiliary plate 25 has the guide portion 25*a* at the opposite side with respect to the projection 25*b* from that of the first embodiment. Consequently, when the pin 18 comes to the intersection 12*f* between the first cam groove 12*a* and the third cam groove 12*d* in the continuous print mode, the pin 18 deviates from the first cam groove 12*a*, riding on the guide portion 25*a*. At this time, the pin 18 shifts down slightly by the difference in radius (R1–R3) between the first cam groove 12*a* and the guide portion 25*a*, although such a slight shift of the pin 18 does not affect the printing ribbon position with respect to type. The advantage of this embodiment is that it is easy to manufacture the cam auxiliary plate 25.

According to the present invention, as understood from the above, the disc cam 12 is allowed to rotate in one direction C in the continuous printing operation due to the circular first cam groove 12*a*. This permits the rotation direction of the disc cam 12 for printing operation to differ from that for correction operation. Therefore, it is possible to wind either the printing ribbon 23 or the correction ribbon 20 depending upon the rotation direction of the disc cam 12.

Thus, the present invention eliminates the conventional problem that the printing ribbon 23 is wound during the correction operation.

In addition, continuous printing operation is very fast because the disc cam 12 rotates in one direction C. According to the present invention, the third cam groove 12*d* for correction operation crosses the circular first cam groove 12*a* for continuous printing operation. Since the guide portion 14*a* or 25*a* of the cam auxiliary plate 14 or 25 prevents the cam follower pin 18 from deviating from its proper course at the intersection 12*f*, however, the printing ribbon 23 can be always held at the proper position during the continuous printing operation.

While only certain embodiments of the present invention have been described, it will be apparent to those skilled in the art that various changes and modifications may be made therein without departing from the spirit and scope of the present invention as claimed, and all such modifications as would be obvious to one skilled in the art are intended to be included within the scope of the following claims.

What is claimed is:

1. An electronic typewriter ribbon lift-up apparatus in which a ribbon cartridge holder vertically mounting a printer ribbon and a correction ribbon is pivotable by a lever mechanism and is engaged with a cam follower pin of a ribbon-lifting disc cam, said disc cam being provided with a printing cam groove and a correction cam groove and being rotatable about a rotation axis from an original position by operation of control means for selective pivoting of the ribbon cartridge holder to one of a printing position and a correcting position, wherein said disc cam has a circular first cam groove for continuous printing operation, a second cam groove for single type printing operation starting from a home position and communicating with the first cam groove, and an arc third cam groove for correcting operation starting from the home position and crossing the first cam groove, said first cam groove having a specified radius with the rotation axis of the disc cam being a center thereof, said third cam groove having a smaller radius than said specified radius of the first cam groove, and wherein a cam auxiliary plate rotatably and coaxially provided on the disc cam comprises a guide portion for the intersection between said first and third cam grooves, and a projection extending at least to the home position to ensure the return of the disc cam to the original position.

2. An electronic typewriter ribbon lift-up apparatus for selectively pivoting a ribbon cartridge holder to one of a printing position and a correcting position by a disc cam provided with cam grooves for printing and correcting operations, respectively, wherein said disc cam is pivotable from an original position about a pivot axis and has a circular first cam groove for continuous printing operation, a second cam groove for single type printing operation starting from a home position and communicating with the first cam groove, and an arc third cam groove for correcting operation starting from the home position and crossing the first cam groove, said first cam groove having a specified radius with the rotation axis of the disc cam as a center thereof, said third cam groove having a smaller radius than said specified radius of the first cam groove, and wherein a cam auxiliary plate rotatably and coaxially provided on the disc cam comprises a guide portion for the intersection between said first and third cam grooves, and a projection extending at least to the home position to ensure the return of the disc cam to the original position.

3. The electronic typewriter ribbon lift-up apparatus of claim 2, wherein in the continuous printing operation, the disc cam rotates in a forward direction using the circular first cam groove, and when a cam follower pin comes to the intersection between the first and third cam grooves during the forward rotation of the disc cam, the guide portion of the cam auxiliary plate prevents the cam follower pin from slipping off the first cam groove into the third cam groove.

4. The electronic typewriter ribbon lift-up apparatus of claim 3, wherein a printing ribbon and a correction ribbon are mounted on the typewriter ribbon lift-up apparatus and wherein the disc cam rotates in a forward direction in the printing operation and in a reverse direction in the correction operation, the typewriter ribbon lift-up apparatus winding only the printing ribbon for the forward rotation of the disc cam and winding only the correction ribbon for the reverse rotation of the disc cam, thereby preventing the printing ribbon from being wound in the correcting operation.

* * * * *